US007946757B2

(12) United States Patent
Buttet et al.

(10) Patent No.: US 7,946,757 B2
(45) Date of Patent: May 24, 2011

(54) BASE MODULE FOR TIMEPIECE, IN PARTICULAR WRISTWATCH

(75) Inventors: Mathias Buttet, Divonne les Bains (FR); Enrico Barbasini, Ambilly (FR); Michel Navas, Collonges (FR)

(73) Assignee: BNB Concept SA (CH)

( * ) Notice: Subject to any disclaimer, the term of this patent is extended or adjusted under 35 U.S.C. 154(b) by 169 days.

(21) Appl. No.: 12/293,154

(22) PCT Filed: Feb. 3, 2007

(86) PCT No.: PCT/EP2007/000938

§ 371 (c)(1),
(2), (4) Date: Sep. 16, 2008

(87) PCT Pub. No.: WO2007/107204

PCT Pub. Date: Sep. 27, 2007

(65) Prior Publication Data

US 2009/0103399 A1 Apr. 23, 2009

(30) Foreign Application Priority Data

Mar. 17, 2006 (CH) ..... 0414/06

(51) Int. Cl.
*G04B 17/20* (2006.01)

(52) U.S. Cl. ..... 368/170; 368/127; 368/140; 368/169

(58) Field of Classification Search ..... 368/127, 368/140, 169, 170

See application file for complete search history.

(56) References Cited

U.S. PATENT DOCUMENTS

| | | | | |
|---|---|---|---|---|
| 1,981,997 | A | 11/1934 | Freel | |
| 2,604,940 | A | 7/1952 | Heptinstall | 368/5 |
| 3,574,995 | A | 4/1971 | Turner | |
| 3,898,792 | A * | 8/1975 | Insley et al. | 368/185 |
| 3,903,687 | A * | 9/1975 | Marquis | 368/222 |
| 4,057,959 | A * | 11/1977 | Insley et al. | 368/222 |
| 4,060,972 | A * | 12/1977 | Kimura et al. | 368/73 |
| 6,685,352 | B1 * | 2/2004 | Capt et al. | 368/206 |
| 6,846,104 | B2 * | 1/2005 | Geyer | 368/127 |
| 6,863,435 | B2 * | 3/2005 | Moteki et al. | 368/140 |
| 6,914,340 | B2 * | 7/2005 | Becker et al. | 290/1 R |
| 7,036,977 | B2 * | 5/2006 | Muhle | 368/170 |
| 7,316,504 | B1 * | 1/2008 | Mock et al. | 368/127 |

FOREIGN PATENT DOCUMENTS

| | | |
|---|---|---|
| FR | 1 195 976 A | 11/1959 |
| FR | 2 176 161 A1 | 10/1973 |
| GB | 1 411 453 | 10/1975 |

OTHER PUBLICATIONS

International Search Report dated Sep. 12, 2007, issued in corresponding international application No. PCT/EP2007/000938.

* cited by examiner

*Primary Examiner* — Renee Luebke
*Assistant Examiner* — Jason Collins
(74) *Attorney, Agent, or Firm* — Ostrolenk Faber LLP

(57) ABSTRACT

The invention concerns a base module comprising a barrel device, a display device, and a power reserve indicator, all the components of the module being placed vertically relative to the flanks of the case, and the adjusting member being arranged visibly and directly accessible on the flank of the case.

13 Claims, 6 Drawing Sheets

BASE MODULE FOR TIMEPIECE, IN PARTICULAR WRISTWATCH

CROSS REFERENCE TO RELATED APPLICATIONS

Figure 1:
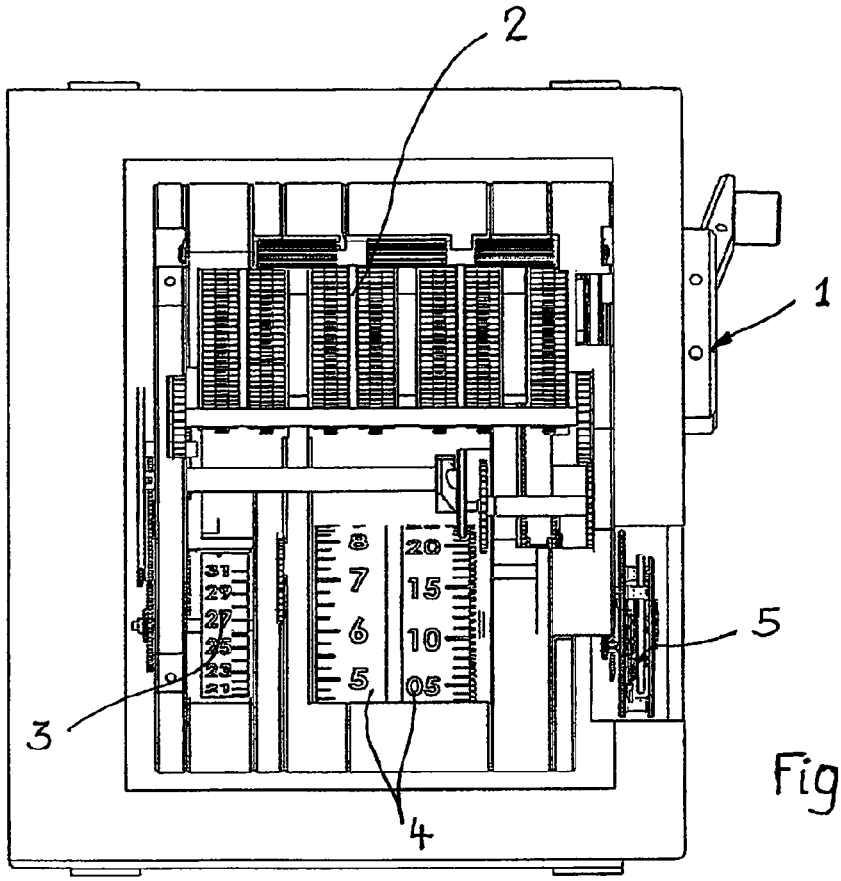

The present application is a 35 U.S.C. §371 National Phase conversion of PCT/EP2007/000938, filed Feb. 3, 2007, which claims benefit of Swiss Application No. 00414/06, filed Mar. 17, 2006, the disclosure of which is incorporated herein by reference. The PCT International Application was published in the French language.

The complication watches found on the watch market comprise a base movement to which complementary modules are attached that are horizontally arranged above or below the base movement. These complementary modules are used to indicate data such as the calendar, date, weekday, day of the month, etc. By these complementary modules that are horizontally arranged, the thickness of the watch is considerably increased.

The invention consists in proposing a module for timepiece, particularly wristwatch, that will admit adding one or several additional modules to be placed side by side. By this arrangement the height of the watch can be limited while using good part of the users arm.

The base module will then have gear trains and arbors that are no longer horizontal relative to the watch case but develop perpendicularly in said case. Such a watch will then have a configuration that is altogether new, and will offer lateral sides where the winding mechanism and display organs may be placed, as well as the adjusting organs, while all arbors and parts of the watch thus realized will then be vertically inserted into the case.

The base module for timepiece, particularly wristwatch, is characterized in that it comprises a barrel device or mechanism that is coupled to a regulating organ and to a display device, where all the gear trains constituting the base module are set up vertically relative to the flank of the module's case, the regulating organ being arranged so as to be visible on one of the flanks of the case, and provide direct access for its adjustment.

The module may have a winding crank coaxial with the barrel device that is set up on the flank of the case.

According to a preferred embodiment, the barrel device comprises several barrels connected pairwise by intermediate wheels.

The barrel device may be coupled directly to a power reserve indicator.

A tourbillon may be present as the regulating organ.

In a preferred embodiment, the barrel device may have seven barrels arranged so as to ensure a power reserve of thirty-one days.

The elements of the time display device just like the display elements of the module such as power reserve or other display items may be present in the form of cylindrical rollers driven by the barrel device.

The winding crank, finally, could be a folding crank.

The base module object of the present invention may take additional modules for any customary watch indication such as phases of the moon, indication of the day and date, etc., these modules being in juxtaposition with the base module, and each module having its own drive shaft that can be coupled to the base module or to the next additional module.

The drawing shows by way of example an embodiment of a base module for timepiece, particularly wristwatch, according to the invention.

Figure 2:
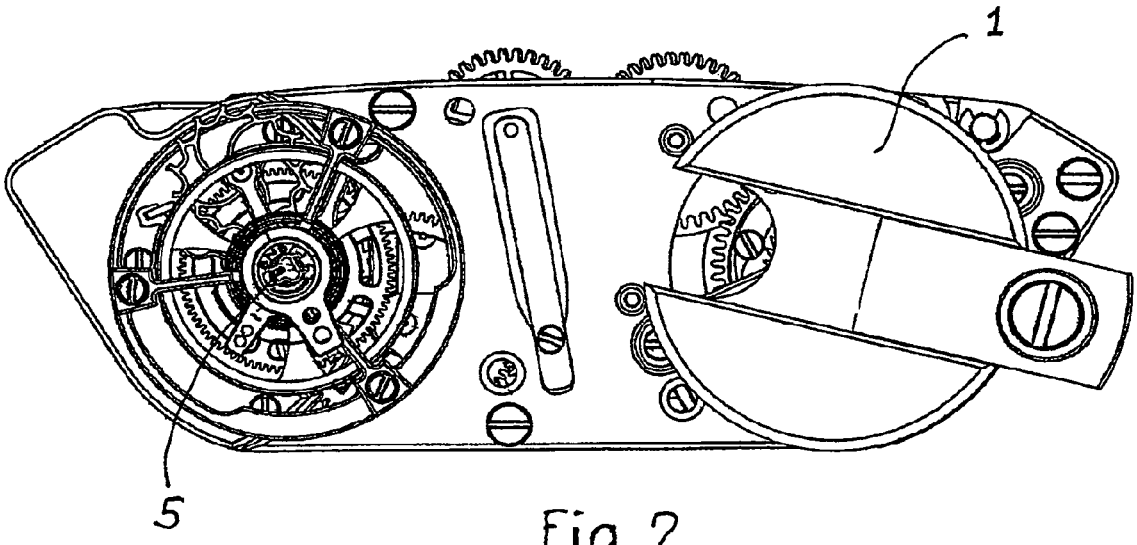
Figure 3:
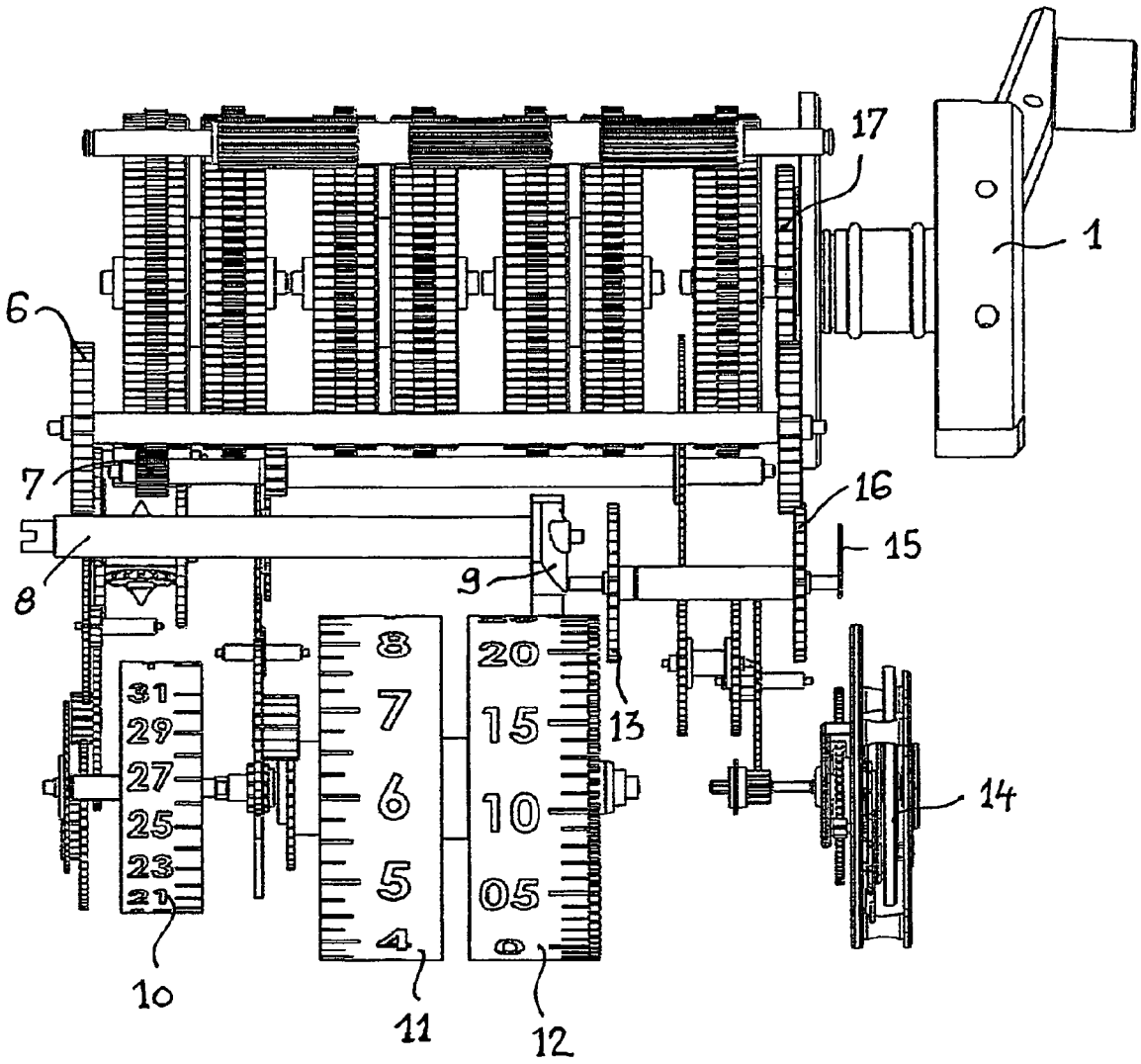
Figure 4:
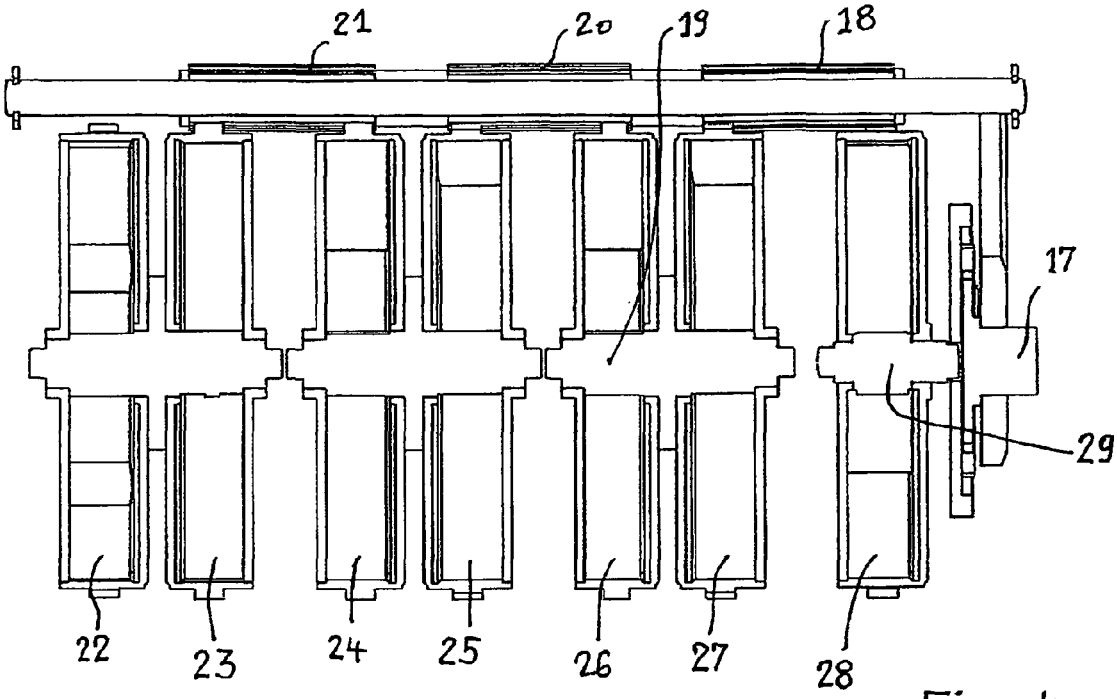
Figure 5:
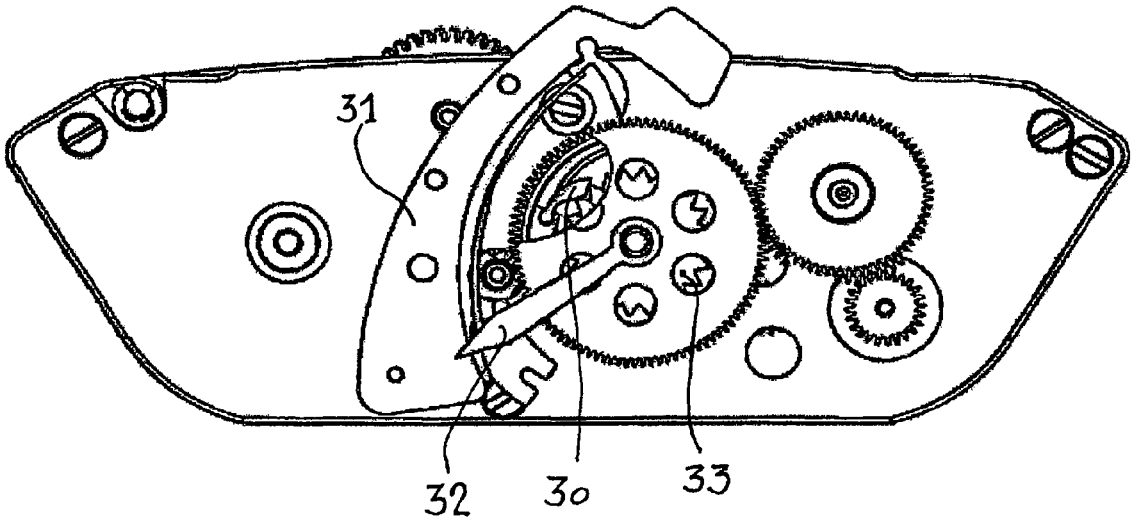
Figure 6:
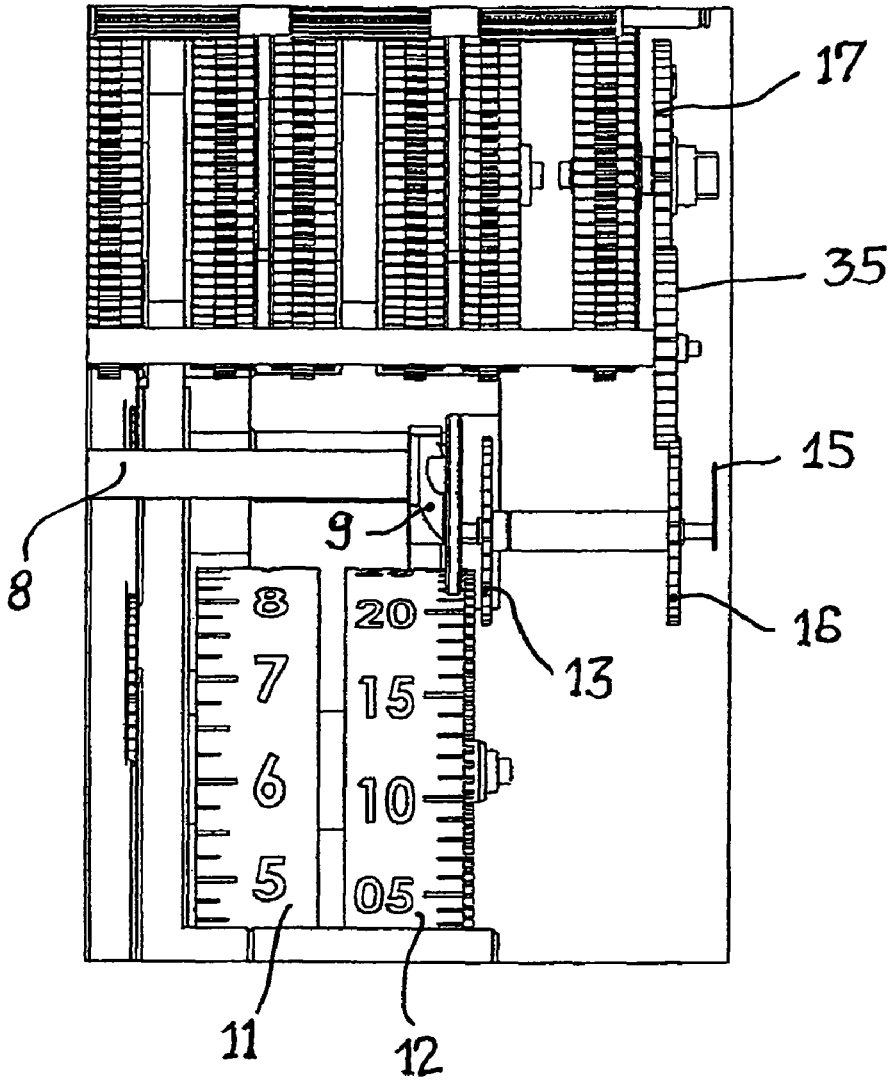
Figure 7:
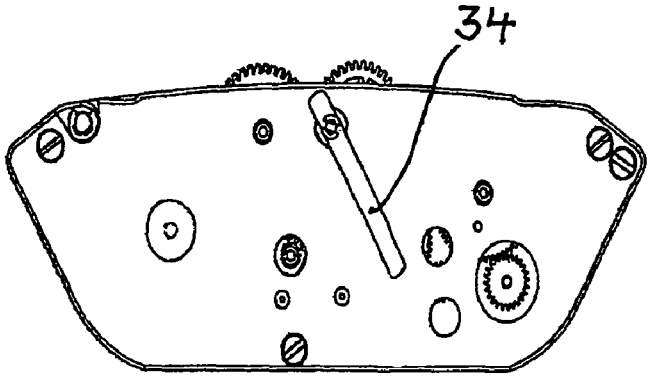
Figure 8:
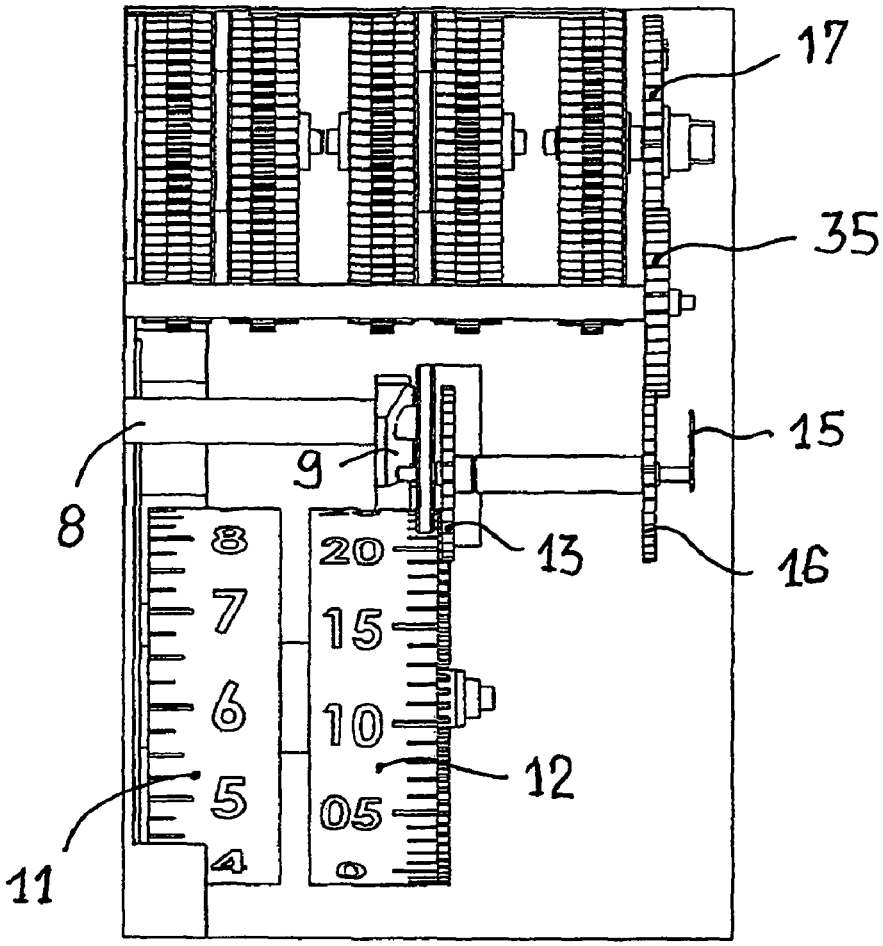
Figure 9:
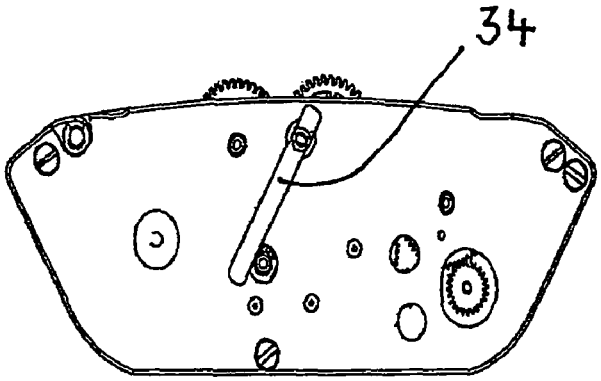
Figure 10:
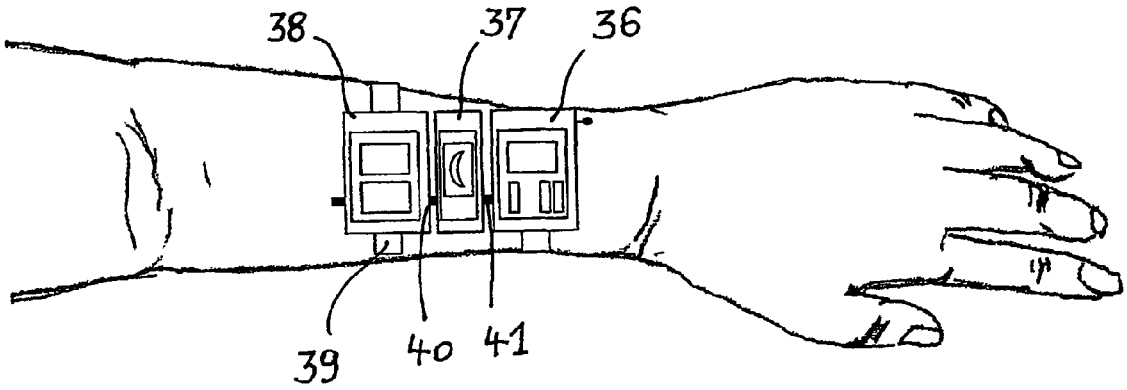

In the drawing,

FIG. 1 is a top view of a base module for timepiece,

FIG. 2 is a view of the module of FIG. 1 taken from the right-hand flank, FIG. 3 is a view of a barrel mechanism in the module of FIG. 1, FIG. 4 is a detailed view of the barrel mechanism of FIG. 3 explaining the assembly of seven barrels contained in the mechanism, FIG. 5 is a view of the module of FIG. 1 taken from the left-hand flank, FIG. 6 and FIG. 7 are top and side views of the central part of the module showing the functioning of the module during winding, FIG. 8 and FIG. 9 are top and side views of the central part of the module showing the functioning of the module during setting, and FIG. 10 is a view of the base module of FIG. 1 provided with a case, and shown on the arm of a user in combination with two additional modules.

The module shown in the drawing is intended for a wristwatch, and admits the addition of one or several additional juxtaposed modules. By this arrangement one can limit the height of the watch and use as much as the entire length of a users arm for additional modules.

This watch is particular in that it has a power reserve of thirty-one days (up to now, the largest power reserve obtained in a mechanical watch has been fifteen days); and in that is has all its elements vertically arranged.

As shown in FIGS. 1 and 2, the watch is provided with a crank (1) actuating a barrel device or mechanism (2). This barrel device (2) is coupled via an intermediate wheel train to a power reserve indicator on a roller (3). The barrel device (2) on the other hand is coupled via another intermediate wheel train to a regulating organ, here a tourbillon (5). The display (4) of hours and minutes is also driven by the barrel device (2).

The regulating organ (5) that is a tourbillon cage, a karussel, or a balance, for example, is positioned vertically on one of the flanks of the watch, thus facilitating access for fine adjustments. There is no longer any need for dismantling the watch in order to provide access to the regulating organ, which is an undeniable advantage of the module. The regulating organ (5) on the other hand is directly visible on the flank of the watch.

The crank (1) is coaxial with the barrel device; it may be folding, as shown in its open position in FIG. 2.

The power reserve is defined as the product of the number of turns of the barrel spring's development, the number of barrels, and the ratio of the number of teeth of the barrel to the number of teeth of the center wheel.

The module's barrel device comprises seven power reserve barrels.

The module shown in the drawing thus provides for an easy "accumulation" of the energy furnished by the barrels, owing to the particular assembly shown in FIGS. 3 and 4.

In function, the barrel device or mechanism of FIGS. 3 and 4 is as follows.

During winding, when crank (1) (FIG. 3) is operated, ratchet wheel (17) that is solidly attached to it will tension the barrel (28) via its staff (29) (FIG. 4). When barrel spring (28) has accumulated enough energy, it will drive the drum of barrel (27) via the barrel's intermediate wheel (18). Via the spring of barrel (27), the drum of barrel (27) drives the barrel's double arbor (19). This arbor (19) that is shared by two barrels (26) and (27) drives the spring of barrel (26), By the same principle, barrel (26) drives barrel (25) via intermediate wheel (20). This will continue until tensioning of barrel (22) is complete. While barrel (22) unwinds, in addition to providing the energy required for the watch to function, barrel (22) decrements the power reserve indicator via an intermediate wheel train and a differential.

While barrel (22) unwinds, barrel (23) will tension it at once. While barrel (23) unwinds, barrel (24) will tension it, thus maintaining a constant tensioning between each of the barrels. It is the same for all other barrels except for barrel (28), which can only be tensioned by crank action. This configuration ensures for barrel (22) a tensioning lasting very long, viz., the equivalent of thirty-one days. All barrels are wound when the roller that is the power reserve indicator (10) displays the number 31.

According to a variant that is not shown, it can be envisaged to add a module containing further barrels, so as to increase the watch's power reserve even more.

As shown in the drawing, the base module has a coaxial display and arrangement for the indications of power reserve (10), hours (11) and minutes (12). However, the display and indication of the power reserve need not be coaxial with the hours and minutes.

According to a variant, it is possible to insert on the module's flank a further time zone in the extension of the dial train, thanks to a star wheel (33) of twenty-four teeth that drives a hand (32), to a jumper spring (30), and to a star-wheel corrector (31) that allows its setting (FIG. 5). A star wheel of twelve teeth may be used instead of the star wheel of twenty-four teeth (33) in order to obtain a twelve-hour time zone.

The base module just described is provided with a device making it possible to either wind the barrels or set the time.

The winding as shown in FIGS. 6 and 7 is carried out as follows.

When the lever (34) that may take up two positions on the flank of the watch is in the winding position, the inclined plane (9) that is solidly attached to it via arbor (8) is the high position.

The crank drives ratchet wheel (17), which drives the wheel (35) engaged with wheel (16).

Thanks to the effect of blade spring (15), the clutch pinion integral with the wheel (16) is in constant contact with the face of the inclined plane (9). Since wheel (13) idles, the roller (12) of the minutes is not driven. Winding of the barrels thus is done while the setting of time is not thrown into gear, and is not perturbed.

Setting the time in the base module just described is done as follows, while referring to FIGS. 8 and 9.

While lever (34) is in the position of setting the time, arbor (8) on the flank of the watch rotates bringing the inclined plane (9) solidly attached to it into the low position. The crank drives ratchet wheel (17), which drives wheel (35) engaging with wheel (16). Thanks to the effect of blade spring (15), the clutch pinion solidly attached to wheel (16) is in constant contact with the inclined plane (9). Since wheel (13) no longer idles, the roller of the minutes (12) and the roller of the hours (11) are both driven.

As shown in FIG. 10, one or several additional modules may be added to the base module (36). These modules are cases that may display indications of the day, the phase of the moon, images, and/or any other desirable indication or item that can be displayed. The additional modules are connected to the base watch via the pinion of the hour wheel (41). Each module has its own arbor (40) for the addition of further modules.

This arbor may be retractable or not. The additional modules may be provided with a watchband (39) or not. The example of FIG. 10 includes a base module (38), a module indicating the phases of the moon (37), and a module displaying day and date (38).

The base module just described is not limited in its use to that in a wristwatch, but may as well drive a pocket watch or pendulum clock.

What is claimed is:

1. A base module for a timepiece including a casing having parallel flanks positioned as lateral sides of the casing, the base module comprising:

a regulating organ positioned at one flank of the casing and comprising a tourbillon, a karussel or a balance;

a display device positioned and configured to convey visual horological information to a user;

gear trains, all gear trains of the base module being vertically placed relative to the flanks of the casing;

a barrel device coupled to the regulating organ and to the display device; and the regulating organ being placed so as to be visible on one of the flanks of the casing, and so as to permit direct access by a user to the regulating organ for regulation of the regulating organ.

2. The module according to claim 1, further comprising a winding crank coaxial with the barrel device and placed on a flank of the casing.

3. The module according to claim 1, wherein the barrel device comprises several barrels connected pairwise by intermediate wheels.

4. The module according to claim 1, wherein the barrel device is coupled directly to a power reserve indicator.

5. The module according to claim 1, wherein the regulating organ comprises a tourbillon.

6. The module according to claim 3, wherein the barrel device comprises seven barrels arranged to ensure a power reserve of thirty-one days.

7. The module according to claim 1, wherein the display device comprises cylindrical rollers driven by the barrel device.

8. The module according to claim 2, wherein the winding crank is a folding crank.

9. The module according to claim 1, wherein the base module includes an additional module configured to provide horological indication to a user, each additional module comprising its own drive staff.

10. The module according to claim 9, wherein the additional module indicates phases of the moon.

11. The module according to claim 9, wherein the additional module indicates a day of the week.

12. The module according to claim 9, wherein the additional module indicates a date.

13. The module according to claim 1, wherein the timepiece is a wristwatch.

* * * * *